US009686626B2

(12) United States Patent
Reuss

(10) Patent No.: US 9,686,626 B2
(45) Date of Patent: Jun. 20, 2017

(54) AUDIO SYSTEM AND METHOD

(71) Applicant: Harman Becker Automotive Systems GmbH, Karlsbad (DE)

(72) Inventor: Michael Reuss, Bretten (DE)

(73) Assignee: Harman Becker Automotive Systems GmbH, Karlsbad (DE)

( * ) Notice: Subject to any disclaimer, the term of this patent is extended or adjusted under 35 U.S.C. 154(b) by 0 days.

(21) Appl. No.: 14/942,465

(22) Filed: Nov. 16, 2015

(65) Prior Publication Data

US 2016/0150346 A1 May 26, 2016

(30) Foreign Application Priority Data

Nov. 21, 2014 (EP) ..... 14194268

(51) Int. Cl.
*H04R 5/02* (2006.01)
*H04S 7/00* (2006.01)

(52) U.S. Cl.
CPC ..... *H04S 7/303* (2013.01); *H04S 7/301* (2013.01); *H04S 2400/01* (2013.01)

(58) Field of Classification Search
CPC ..... H04S 7/303; H04S 7/301; H04S 2400/01
See application file for complete search history.

(56) References Cited

U.S. PATENT DOCUMENTS

2004/0264704 A1 12/2004 Huin et al.
2005/0152557 A1 7/2005 Sasaki et al.
2006/0159276 A1 7/2006 Tsutsui
2008/0226084 A1* 9/2008 Konagai ..... H04S 3/008 381/17
2010/0323793 A1* 12/2010 Andall ..... A63F 13/54 3/54
2013/0148812 A1* 6/2013 Corteel ..... H04S 7/30 381/17
2013/0343550 A1* 12/2013 Araki ..... H04S 3/00 381/17
2014/0056430 A1* 2/2014 Choi ..... H04S 5/00 381/17

(Continued)

FOREIGN PATENT DOCUMENTS

WO 2006054270 A1 5/2006
WO 2012164444 A1 12/2012

(Continued)

OTHER PUBLICATIONS

Theile, G. et al., "Wave Field Synthesis: A Promising Spatial Audio Rendering Concept," Acoustical Science and Technology, vol. 25, No. 6, Jun. 1, 2004, 7 pages.

(Continued)

*Primary Examiner* — Simon Sing
(74) *Attorney, Agent, or Firm* — McCoy Russell LLP

(57) ABSTRACT

An audio system comprises at least one processor configured to receive multi-channel audio data and comprising a plurality of output channels. Control instructions are established based on preset positions of a plurality of speakers connectable to the output channels and further based on virtual positions of the channels of the multi-channel audio data. The channels of the multi-channel audio data are routed to the output channels based on the control instructions.

18 Claims, 7 Drawing Sheets

(56) References Cited

U.S. PATENT DOCUMENTS

| | | | | |
|---|---|---|---|---|
| 2014/0219455 | A1* | 8/2014 | Peters | H04S 5/00 381/17 |
| 2014/0314239 | A1* | 10/2014 | Meyer | G06F 3/165 381/58 |
| 2015/0264502 | A1* | 9/2015 | Aoki | H04S 5/005 381/17 |

FOREIGN PATENT DOCUMENTS

| | | | |
|---|---|---|---|
| WO | WO 2012/164444 | A1 * | 12/2012 |
| WO | WO 2014/077374 | A1 * | 5/2014 |

OTHER PUBLICATIONS

European Patent Office, Extended European Search Report Issued in Application No. 14194268.0, Jun. 2, 2015, 4 pages.

* cited by examiner

AUDIO SYSTEM AND METHOD

CROSS REFERENCE TO RELATED APPLICATIONS

The present application claims priority to European Patent Application No. EP14194268, entitled "AUDIO SYSTEM AND METHOD," and filed on Nov. 21, 2014, the entire contents of which are hereby incorporated by reference for all purposes.

TECHNICAL FIELD

Various embodiments relate to an audio system and to a corresponding method. In particular, various embodiments relate to techniques of routing channels of a multi-channel audio data to output channels of the audio system.

BACKGROUND

It is known to provide multi-channel audio data where audio tracks are provided for, e.g., two, five, seven, or an even larger number of channels. Playback of the multi-channel audio data can be achieved by employing a respectively configured audio system which typically comprises at least one processor having a respective number of output channels and possibly an amplifier as an end stage to which speakers may be connected.

Typically, the multi-channel audio data is provided with respect to a certain standard arrangement of speaker positions. If the positions of the speakers connected to the output channels do not deviate significantly from this standard arrangement, a good listening experience may be achieved. In particular, it may be possible to compensate to some extent for a misalignment of the positions of the speakers with respect to the standard arrangement. For example, differences in the distance between the various speakers with respect to an audio sweet spot may be compensated for. Typically, the audio sweet spot is therefore defined with respect to the positions of the speakers. At the audio sweet spot, playback of the plurality of speakers may be synchronized with respect to each other. Playback of surround sound becomes possible. In particular, typically a particularly good listening experience may be provided if the listening position of a user coincides with an audio sweet spot.

According to reference implementations, it is therefore known to compensate for deviations of the distance of the actual positions of the speakers with respect to audio sweet spot. Yet, such techniques face certain restrictions. According to the reference implementations, it may not be possible or only possible to a limited degree to compensate for deviations in other degrees of freedom in the setup of the speakers and/or changes of the listening position.

SUMMARY

Thus, the disclosure provides advanced techniques of processing multi-channel audio data which remedy or alleviate at least some of the above-mentioned restrictions. For example, the disclosure provides for such techniques which enable to flexibly modify the routing of the audio data in view of changes of the listening position.

According to an embodiment, an audio system is provided. The audio system comprises at least one processor. The at least one processor is configured to receive multi-channel audio data from an audio source. The multi-channel audio data includes a plurality of channels. The at least one processor comprises a plurality of output channels. Each output channel is configured to be connected to a respective speaker. The at least one processor is coupled to a memory. The at least one processor is further configured to receive, from the memory, preset positions of the plurality of speakers and virtual positions. The virtual positions are associated with the plurality of channels of the multi-channel audio data. The at least one processor is further configured to establish control instructions based on the preset positions and the virtual positions. The at least one processor is further configured to route the channels of the multi-channel audio data to the output channels based on the control instructions.

For example, the multi-channel audio data may comprise two, three, four, five, six, seven, or even more channels. Each channel of the multi-channel audio data may relate to a specific audio track which is specified by digital or analogue audio data. For example the audio source may be a storage medium which stores the multi-channel audio data. Alternatively or additionally it is also possible that the audio source is a recording entity which records the multi-channel audio data.

Each one of the plurality of output channels may comprise a respective connector to which a speaker can be connected using, e.g., a wired connection. Generally, it is also possible that the speakers are connectable to the output channels via a wireless data communication. In this case, the output channels may each comprise a wireless interface. Generally, it is possible that the audio system also comprises the speakers. However, it is also possible that speakers are separate entities.

It is possible that the routing comprises audio processing of at least one channel of the multi-channel audio data is executed based on the control data. For example, the audio processing may employ techniques of digital audio processing and/or analogue audio processing. The audio processing may include applying filters, effects such as echo, fade, etc., delays, and/or phase shifts, etc.

In reference implementations, each channel of the multi-channel audio data is fixedly routed to a given output channel. Thus, according to reference implementations, each channel of the multi-channel audio data is fixedly associated with a certain speaker and is audibly perceived at the respective preset position of the certain speaker. From this routing according to reference implementations, the audio sweet spot may result.

According to various embodiments, the routing of the channels of the multi-channel audio data is flexibly set based on the control instructions. Thus, the virtual positions of the speakers—corresponding to the different channels of the multi-channel audio data—can be flexibly set. Here, the routing can include a phase shift or delay for the various output channels, e.g., audio processing. There may not be a fixed one-to-one correspondence between channels of the multi-channel audio data and the output channels.

The preset positions of the speakers may correspond to the actual positions of the speakers; e.g., the preset positions may be provided measuring the actual position of the speakers and/or retrieving the actual position of the speakers from a user input and/or estimating the actual position of the speakers, etc. Thus, the preset positions may be an approximation of the actual positions of the speakers.

The virtual positions may correspond to positions where the audio content of the associated channel of the multi-channel audio data is audibly perceived by a listener; in other words, different channels of the multi-channel audio data may be perceived at the different virtual positions. Here, in contrast to the above-mentioned reference implementations, it becomes possible that a channel of the multi-channel audio data is audibly perceived at the virtual position which may be flexibly set. The virtual positions may be set to conform with a listening position which may be defined in terms of location and/or orientation. In other words, the virtual position may be referred to as an emulated position of a respective virtual speaker. In general, the virtual positions may coincide or deviate from the preset positions. The virtual positions may be flexibly set or may be varied. This allows to account for changes in the listening position within or even outside of the audio sweet spot.

There may be a one-to-one correspondence between channels of the multi-channel audio data and output channels. For example, each channel of the multi-channel audio data may be routed to a different output channel. However, it is also possible that at least one channel of the multi-channel audio data is routed to a plurality of output channels.

The number of channels of the multi-channel audio data and output channels may vary. For example, the at least one processor may be configured to route a first number of channels of the multi-channel audio data to a second number of output channels based on the control instructions. The first number may be larger or smaller than the second number.

In such a scenario where the first number is smaller than the second number, it is possible to rely on otherwise unused output channels of the audio system to emulate the virtual positions. For example, the audio system may be a 7.1-audio system, providing seven output channels and an additional bass output channel. The multi-channel audio data may provide five audio channels. Then it may be possible to use all seven output channels to flexibly emulate various virtual positions which, e.g., deviate from the actual positions of the speakers.

Generally, the routing may include routing at least one channel of the multi-channel audio data to more than one output channel. The at least one processor may be configured to route at least one channel of the multi-channel audio data to two or more output channels based on the control instructions. For example, the control instructions may specify the amplitudes of each output channel to which the at least one channel of the multi-channel audio data is routed.

If playback of a given channel of the multi-channel audio data is executed for a plurality of output channels, then the corresponding virtual position deviates from the preset positions of the speakers. This allows to flexibly set the virtual position.

Likewise, it is possible that the least one processor is configured to mix at least two channels of the multi-channel audio data to a given output channel based on the control instructions. Thus, at a given output channel, playback of a superposition of a plurality of channels of the multi-channel audio data may be implemented. Then, it becomes possible to flexibly specify the virtual positions for a plurality of channels of the multi-channel audio data.

Said mixing may correspond to adding the amplitudes of the at least two channels of the multi-channel audio data in a defined manner; in particular, an amplitude or relative contribution to the signal output via the given output channel may be specified for each one of the at least two channels. Such information may be provided in the control instructions.

By determining the control instructions and by executing said routing based on the control instructions, it is possible to tailor the virtual positions. In particular, it becomes possible to flexibly set the virtual positions. This flexibly setting of the virtual positions may be—to some degree—independent of the preset positions. Thus, a larger flexibility in the actual positioning of the speakers may be achieved; in particular, it may not be required to physically position the speakers according to a certain standard arrangement for which the multi-channel audio data is provided. It may be possible to account for a varying listening position.

As mentioned above, it may be possible to account for changes of the position and/or the orientation of the listening position of a user. This may be flexibly done by a user according to the user's needs. Generally, it may be possible to adjust the virtual positions of the speakers such that a virtual stage defined by the channels of the multi-channel audio data conforms with the listening position. The virtual stage may be defined in terms of left-right/front-rear directions of the content of the multi-channel audio data. Audible perception of surround sound may be positioned with respect to the virtual stage. For example, if the listening position is rotated by 180°, in a scenario where the virtual positions are not adapted, left and right perception, as well as front and rear perception will be interchanged, respectively. Then, the listening position is rotated, but the virtual stage remains fixed. A degraded listening experience would result. By correspondingly adjusting the virtual positions, e.g., by turning the virtual stage by 180°, it is possible to compensate for this.

It should be noted that even when the virtual positions are adjusted, certain pre-defined settings associated with the speakers may be preserved. In particular, such settings may be persevered which correspond to implementation of the audio sweet spot. For example, adjusting the virtual positions may account for changes in the listening position within the audio sweet spot.

As can be seen from the above, by processing the multi-channel audio signal according to techniques as presented above, the channels can be distributed among the speakers in a manner that the virtual positions are perceived by a listener at positions that are optimal for the given listening situation. This allows to compensate, e.g., for off-center positioning of center speakers or main speakers which are not symmetrically placed.

The audio system may further comprise a human machine interface (HMI). The HMI may be configured to receive a user input from a user of the audio system. The at least one processor may be configured to determine and write to the memory at least one of the preset positions and/or at least one of the virtual positions based on the user input.

For example, the HMI may comprise elements selected from the group comprising: a keyboard, a mouse, a display, a remote control, a wireless transceiver configured to wirelessly receive the user input from a portable user equipment, a Local Area Network (LAN) transceiver configured to receive the user input from a LAN. For example, the user may be able to specify the virtual positions and/or the preset positions in an application executed on a smartphone.

Generally, the user input may take various forms. In one scenario, the user input may specify, for each one of the speakers, a coordinate corresponding to the preset position and a coordinate corresponding to the virtual position; the coordinates may be defined in a reference coordinate system.

In such a scenario, the user may be able to flexibly set and modify all of the preset positions and the virtual positions according to his needs. For example, the user may be able to manually move the virtual positions using the remote control and/or a smartphone application.

It is also possible that the user input is restricted to a more specific information. In particular, the user input may relate to a specific mapping or offset between virtual positions and preset positions. For example, the user input may indicate, for each one of the plurality of speakers, a rotation of a corresponding one of the virtual positions with respect to a reference direction. The reference direction may be optionally defined with respect to an orientation of the preset positions of the plurality of speakers. Alternatively or additionally, the reference direction may be defined by the preset positions, e.g., by the preset position of a center speaker or the like.

In such a scenario as mentioned above, the user may adjust the virtual positions based on the preset positions. This may make it comparably simple to achieve a desired listening experience.

For example, the user input may indicate a uniform rotation of the virtual positions with respect to the reference direction. Thereby, it becomes possible to specifically adapt the orientation of the virtual stage; this may be of value where the orientation of the listening position changes, e.g., without a change of the position of the listening position. This may be the case where the user employs two or more displays for synchronized playback of accompanying visual content. In such a scenario, the user can manually turn the audibly perceived stage.

For example, in such scenarios as mentioned above with respect to the rotation of one or more virtual positions, the preset positions for the speakers may correspond to the actual positions of the speakers. It is possible that the reference direction is defined by means of the actual positions of the speakers; e.g., the reference direction may be defined as a center direction symmetrically located between left and right directions defined by the respective speakers connected to the corresponding output channels. Then, it is possible that by specifying the rotation of the respective virtual positions with respect to the reference direction, particular ones or all of the virtual positions are offset against the reference direction.

Such scenarios that rely on a user input may be combined with presets. For example, the user input may indicate a selection of a given one of a plurality of candidate virtual positions as the at least one virtual position determined by the at least one processor based on the user input. For example, the user may define and store the plurality of candidate virtual positions as the presets. This allows fast and simple selection of the virtual positions. For example, it may be possible that the presets are provided for certain preferred or reoccurring listening positions, e.g., on a couch, a writing table, etc. For example, for the different listening positions different screens for playback of an accompanying visual content may be used. The listener may be orientated in another direction. The listener may switch between different listening positions, e.g., when moving from one part of a room to another part of the room.

It is also possible that the user input indicates a radial offset between the at least one virtual position determined by the at least one processor based on the user input and a reference radial distance. As discussed above with respect to the reference direction, it is possible that the reference radial distance is defined with respect to the preset positions.

In this manner, it is possible that the listener experiences the modified at least one virtual position to be closer or more remote. Thus a re-positioning of the listening position may accounted for. The radial offset may be achieved by appropriately adjusting amplitudes, phase, and/or delay of the routing of the various channels of the multi-channel audio data.

Above, primarily scenarios have been discussed where the user input parameterizes the virtual positions in some manner. However, sometimes it may be desirable to freely move the virtual position of a specific channel; this may be particularly relevant where an immediate audible feedback of the moved virtual position is provided.

The at least one processor may be configured to execute a positioning routine. The positioning routine may comprise the at least one processor routing a given channel of the multi-channel audio data at two or more output channels based on the control instructions established for a present virtual position. The positioning routine further comprises the HMI receiving the user input indicating an offset value for the present virtual position and the at least one processor adjusting said routing of the given channel of the multi-channel audio data based on the offset value. Channels of the multi-channel audio data other than the given channel may be muted. In such a manner, it is possible that the user can manually move the virtual sound sources and receive audible feedback as part of the positioning routine. In such a manner, it is possible that the user can accurately position the virtual position of a speaker.

In a further scenario, the user input may indicate an assignment of the at least one virtual position determined by the at least one processor based on the user input to the at least one preset position determined by the at least one processor based on the user input. In other words, the virtual positions of a specific channel of the multi-channel audio data may be mapped to certain preset positions. Here, the virtual positions may not deviate from the preset positions; nonetheless, a specific routing of channels of the multi-channel audio data to output channels is implemented depending on the user input. In such a scenario, the user may easily switch the routing of the output channels between different channels of the multi-channel audio data.

As can be seen from the above, generally the user input may specify one or more parameters. In particular, the parameters specified by the user input may vary in various scenarios. Generally, based on the user input it is possible to determine at least one of the preset positions and/or at least one of the virtual positions. In this regard, the user input may indicate the at least one virtual position of the at least one speaker and/or the at least one preset position determined by the at least one processor based on the user input with respect to at least one of a position of a display, a position of a user, a head orientation of the user, and a reference coordinate system. In this manner, it becomes possible that the user can easily select the appropriate preset position(s) and/or virtual position(s).

Generally, it is also possible that the virtual positions are determined on input parameters other than the user input. For example, it is possible that the virtual positions are determined automatically or semi-automatically. For example, for this purpose a calibration routine may be executed by the at least one processor. The calibration routine may comprise the at least one processor routing a reference signal via the output channels and the at least one processor controlling at least two microphone interfaces to each receive a recording of a playback of the reference signal as a respective calibration track. Then the at least one processor may be configured to determine the virtual positions based on the detected calibrations signals. By providing the at least two microphone interfaces, stereo recording becomes possible. In particular, it is possible to determine a direction with respect to a reference coordinate system of the various speakers, respectively the preset positions. The playback may be executed serially via the output channels;

only one channel may be activated at a time. For example, the reference signal may be a pulse train signal and/or a signal of a given frequency or frequency bandwidth.

Then it may be possible to, e.g., rotate the virtual positions against the preset positions automatically such that the virtual positions align with a reference direction. The reference direction may, in turn, be defined with the reference coordinate system and/or a user input. For example, the reference coordinate system may be defined by a setup of microphones connected to the microphone interfaces.

Above, primarily techniques of determining the virtual positions and/or the preset positions have been discussed. Once the virtual positions and the preset positions have been established, it is possible to determine the control instructions. The control instructions may allow to appropriately route the channels of the multi-channel audio data to the output channels of the audio system such that the virtual positions are emulated based on the preset positions. In this regard, various techniques of determining the control instructions may be employed.

It is possible that the at least one processor is configured to determine the control instructions for each one of the virtual positions based on a spatial difference between the respective virtual position and at least one respective neighboring one of the preset positions. The at least one processor may be alternatively or additionally configured to determine the control instructions based on a difference vector between the virtual positions and the position of the listening position. Here, a length and/or orientation of the difference vector may be taken into account.

For example, if a virtual position is located in between two preset positions of two speakers, it is possible that both speakers contribute to the playback of the respective channel of the multi-channel audio data. For example, an amplitude of the routing to the different output channels may be determined by the spatial distance between said virtual position and each one of the two preset positions. Further, in order to appropriately account for a direction at which the user is located, the difference vector between the virtual positions and the listening position may be taken into account.

Above, primarily techniques are discussed where the preset positions are determined based on the user input. However, alternatively or additionally, it is also possible, e.g., to measure or otherwise establish the preset positions of the speakers.

This may be done as part of the above-mentioned calibration routine. For example, the audio system may further comprise the at least two microphone interfaces. The at least one processor may be configured to execute the calibration routine. The at least one processor may further be configured to determine the preset positions of the plurality of speakers based on the detected calibration signals.

The determining of the virtual positions and/or the preset positions may involve detecting time differences between the detecting of the playback at each one of the at least two microphone interfaces. Triangulation techniques may be employed.

In such a manner, it is possible to determine the preset positions at a comparably high accuracy. Moreover, automatically determining the preset positions becomes possible. In such scenarios, it may be unnecessary to rely on a user input.

According to an embodiment, a method is provided. The method comprises at least one processor of an audio system receiving multi-channel audio data from an audio source. The multi-channel audio data includes a plurality of channels. The method further comprises the at least one processor receiving preset positions of a plurality of speakers connectable to the audio system via respective output channels. The method further comprises the at least one processor receiving virtual positions associated with the plurality of channels of the multi-channel audio data. The method further comprises the at least one processor establishing control instructions based on the virtual positions and further based on the preset positions. The method further comprises the at least one processor routing the channels of the multi-channel audio data to the output channels based on the control instructions.

For example, the audio system according to a further embodiment can be configured to execute the method according to the presently discussed aspect.

For such a method, effects may be achieved which can be achieved for the audio system according to a further embodiment.

It is to be understood that the features mentioned above and features yet to be explained below can be used not only in the respective combinations indicated, but also in other combinations or in isolation, without departing from the scope of the present disclosure. Features of the above-mentioned aspects and embodiments may be combined with each other in other embodiments.

DETAILED DESCRIPTION

Figure 1:
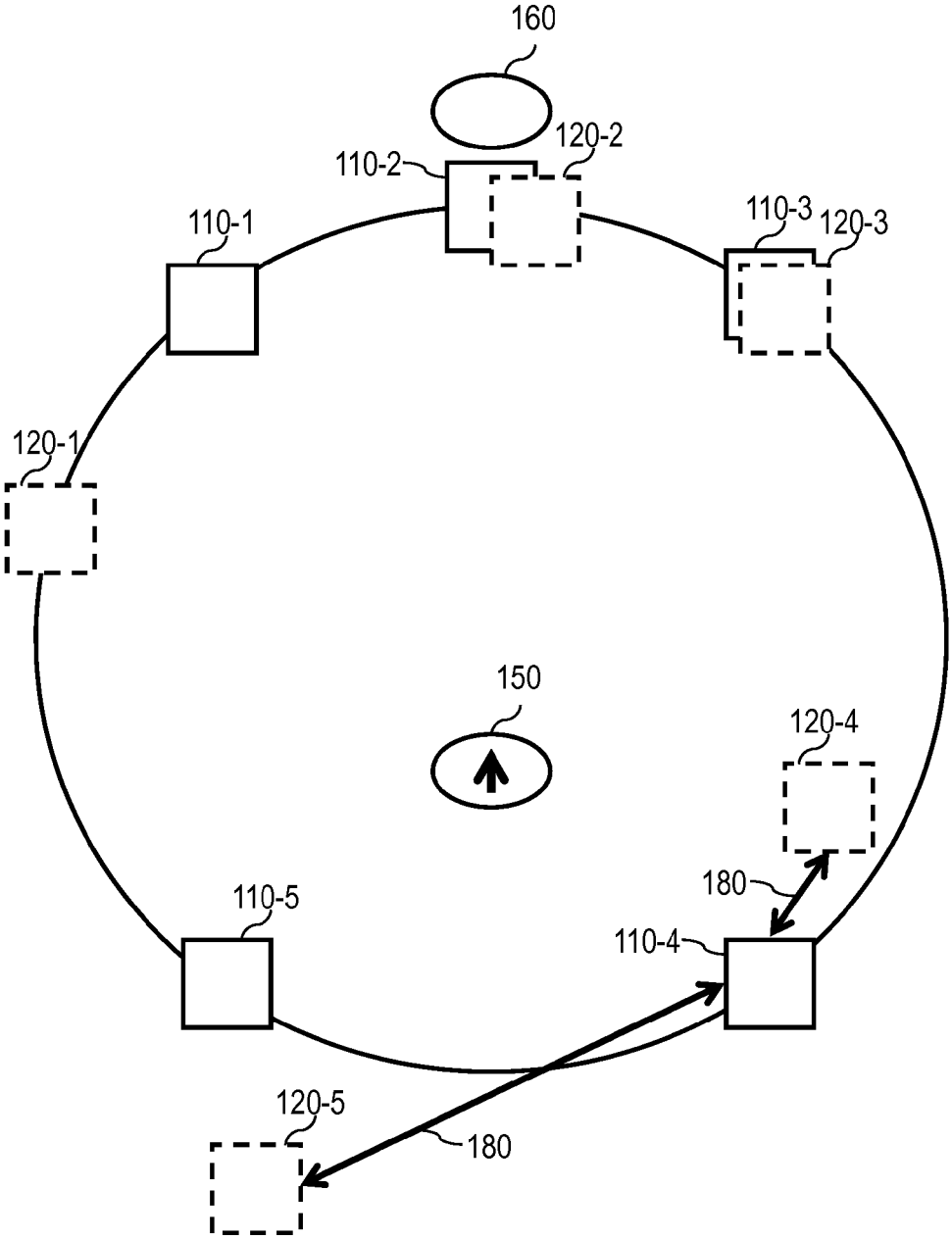
FIG. 1 schematically illustrates preset positions of a plurality of speakers and virtual positions associated with a plurality of channels of multi-channel audio data according to various embodiments.

In the following, embodiments will be described in detail with reference to the accompanying drawings. It is to be understood that the following description of embodiments is not to be taken in a limiting sense. The scope of the disclosure is not intended to be limited by the embodiments described hereinafter or by the drawings, which are taken to be illustrative only.

The drawings are to be regarded as being schematic representations and elements illustrated in the drawings are not necessarily shown to scale. Rather, the various elements are represented such that their function and general purpose become apparent to a person skilled in the art. Any connection or coupling between functional blocks, devices, components, or other physical or functional units shown in the drawings or described herein may also be implemented by an indirect connection or coupling. A coupling between components may also be established over a wireless connection. Functional blocks may be implemented in hardware, firmware, software, or a combination thereof.

Hereinafter, techniques of routing multi-channel audio data at an audio system which comprises one or more processors having a plurality of output channels are discussed. For example, the audio system may be an audio-video receiver or the like. The processor is capable of routing the various channels of the multi-channel audio data to one or more output channels. The routing may include audio processing, e.g., applying filters, adding effects, adding delay, and/or adding a phase shift. Speakers can be connected to the output channels.

This routing is based on control instructions. The control instructions are determined based on preset positions of the speakers and further based on virtual positions associated with the channels of the multi-channel audio data. For example, the preset positions can correspond to actual positions of the speakers while the virtual positions of the speakers can correspond to positions where a virtual speaker corresponding to the associated channel of the multi-channel audio data is audibly perceived by a user. The virtual positions may or may not deviate from the preset positions.

Such a scenario is illustrated in FIG. 1. In FIG. 1, the preset positions 120-1-120-5 of the speakers are shown. In the scenario of FIG. 1, the preset positions 120-1-120-5 are the actual positions of the speakers. For example, the preset positions 120-1-120-5 may be specified by a user via a respective user input or may be measured using, e.g., two or more microphones.

In FIG. 1, it can be seen that the left/right preset positions 120-1 and 120-3 are not symmetrically arranged with respect to the center preset position 120-2. If 5.1 multi-channel audio data is played back using conventional techniques in this scenario, a degraded listening experience results. This is because the left channel of the 5.1 audio data is routed to the speaker corresponding to the preset position 120-1, the center channel of the 5.1 audio data is routed to the speaker corresponding to the preset position 120-2, and so forth. The virtual stage is distorted. The surround sound perceived by the user does not match the content of the multi-channel audio data.

Namely, typically the 5.1 audio data is compiled with respect to a certain standard arrangement of speakers. In the standard arrangement, e.g., the actual positions of left and right front speakers should be symmetrically arranged with respect to a front center speaker according to some standards. As can be seen from FIG. 1 and as explained above, the preset positions 110-1-110-5 deviate from the standard arrangement. The degraded listening experience resulting from this can correspond to a user at a listening position 150 not perceiving playback of a certain channel of the multi-channel audio data at a position conforming with the position for which the content of this channel is provided; the virtual stage may be distorted or otherwise negatively affected.

This may have particular impact where the multi-channel audio data is accompanied by visual content. Then, the listening position 150 may be positioned and orientated such that the playback of the multi-channel audio data fits to the playback of the accompanying visual content on a display 160. The virtual stage and the display 160 may be aligned. In this regard, the listening position 150 may be associated with an orientation (indicated in FIG. 1 by the arrow). If the listener is orientated along said orientation, the audio content may be perceived consistently with the video content. In particular, a center image may coincide with the position of the display 160; the center image is typically the perceived location for a centered or mono audio signal. Such an orientation of the listening position 150 may be of importance also where there is no video content, e.g., for audio-only recordings implementing the perception of surround sound.

To preserve virtual stage even when the preset positions 120-1-120-5 deviate from the standard arrangement of speakers, techniques according to various embodiments can be employed. These techniques rely on the emulation of virtual positions 110-1-110-5. These virtual positions 110-1-110-5 define the positions where the audio content of the channels of the audio data is audibly perceived.

As can be seen, in the scenario of FIG. 1 the virtual positions 110-1-110-5 are arranged according to the standard arrangement for which the 5.1 audio data is compiled, e.g., highly symmetrical and at defined radial distances with respect to the audio listening position 150. Thus, by emulating the virtual positions 110-1-110-5, a better audio experience can be achieved; the virtual stage is properly aligned. The perception of surround sound is aligned with the content of the multi-channel audio data.

The virtual positions 110-1-110-4 are emulated by routing the channels of the multi-channel audio data to the output channels based on respectively determined control instructions. The control instructions are determined based on the preset positions 120-1-120-5 and based on the virtual positions 110-1-110-5. In particular, when determining the control instructions, the distance 180 between the virtual positions 110-1-110-4 and neighboring preset positions 120-1-120-5 can be taken into account.

Figure 2A:
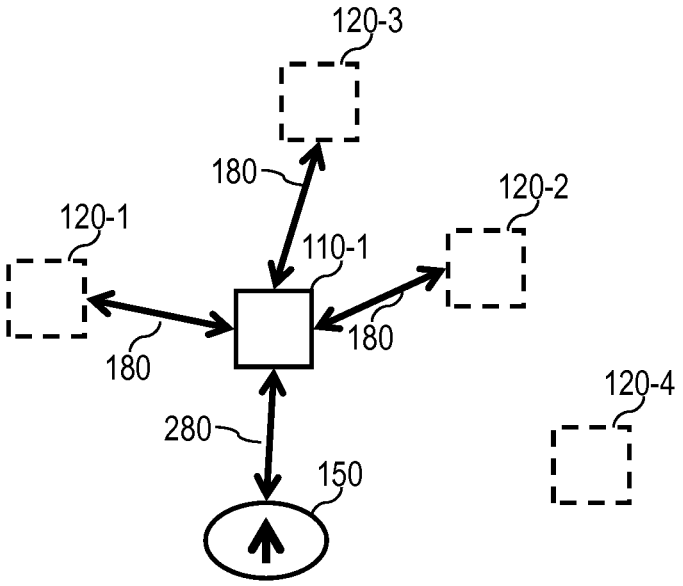
FIG. 2A schematically illustrates the emulation of a virtual position based on a spatial difference between the virtual position and a plurality of neighbouring preset positions of speakers according to various embodiments.

The emulation of a given virtual position 110-1 is shown at greater detail in FIG. 2A. Here, the virtual position 110-1 is emulated by routing the corresponding channel of the multi-channel audio data to the three physical speakers located at the preset positions 120-1, 120-2, 120-3 via the respective output channels. The routing can include a delay or phase shift for the corresponding output channels such that a coherent superposition of the signals originating from the different physical speakers is audibly perceived. Alternatively or additionally, the amplitude with which the given channel is routed to each one of the speakers at the preset positions 120-1-120-3 can be set appropriately. Then, the origin of the corresponding sound is perceived at the virtual position 110-1.

As can be seen from FIG. 2A, when determining the corresponding control data, techniques of triangulation may be taken into account based on the distances 180. Further, the difference vector 280 between the virtual position 110-1 and the location of the listening position 150 may be taken into account to avoid ambiguities in the routing.

Figure 2B:
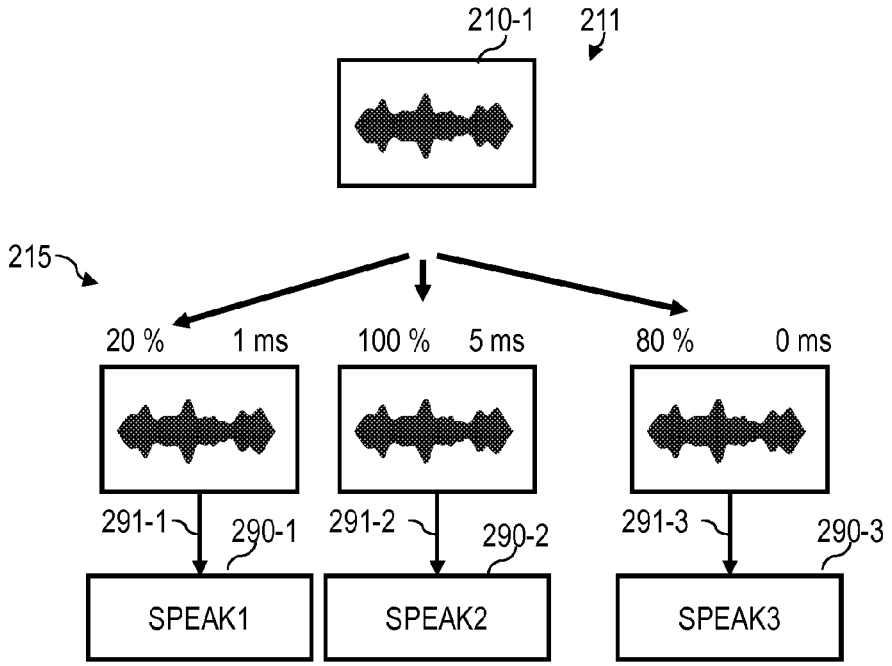
FIG. 2B schematically illustrates the routing of a channel of multi-channel audio data to a plurality of output channels of an audio systems to emulate a corresponding virtual position according to various embodiments.

In FIG. 2B, the routing of the respective channel 210-1 of the audio data 211 is illustrated. The channel 210-1 is routed to the three output channels 291-1, 291-2, 291-3 corresponding to the three physical speakers 290-1, 290-2, 290-3 discussed with respect to FIG. 2A. The respective control data 215 specifies to which of the output channels 291-1-291-3 the channel 210-1 of the multi-channel audio data 211 is routed at what amplitude (given in percentage in FIG. 2B), as well as a delay (given in milliseconds in FIG. 2B). Generally, the control data may specify further or different information such as phase, filter parameters, etc. By such techniques as mentioned above, the superposition of the playback of the channel 210-1 can be achieved, resulting in the virtual position 110-1 deviating from the corresponding preset positions 120-1-120-3.

In FIG. 2B, the scenario is shown for the single channel 210-1 of the multi-channel audio data 211. When considering a plurality of channels 210-1-210-4 of the multi-channel audio data 211 (cf. FIG. 2C), it is possible that the processor mixes the plurality of channels 210-1-210-4 to a given output channel 291-1. In such a scenario, the virtual positions 110-1-110-5 for a plurality of channels 210-1-210-4 may be flexibly set.

Figure 2C:
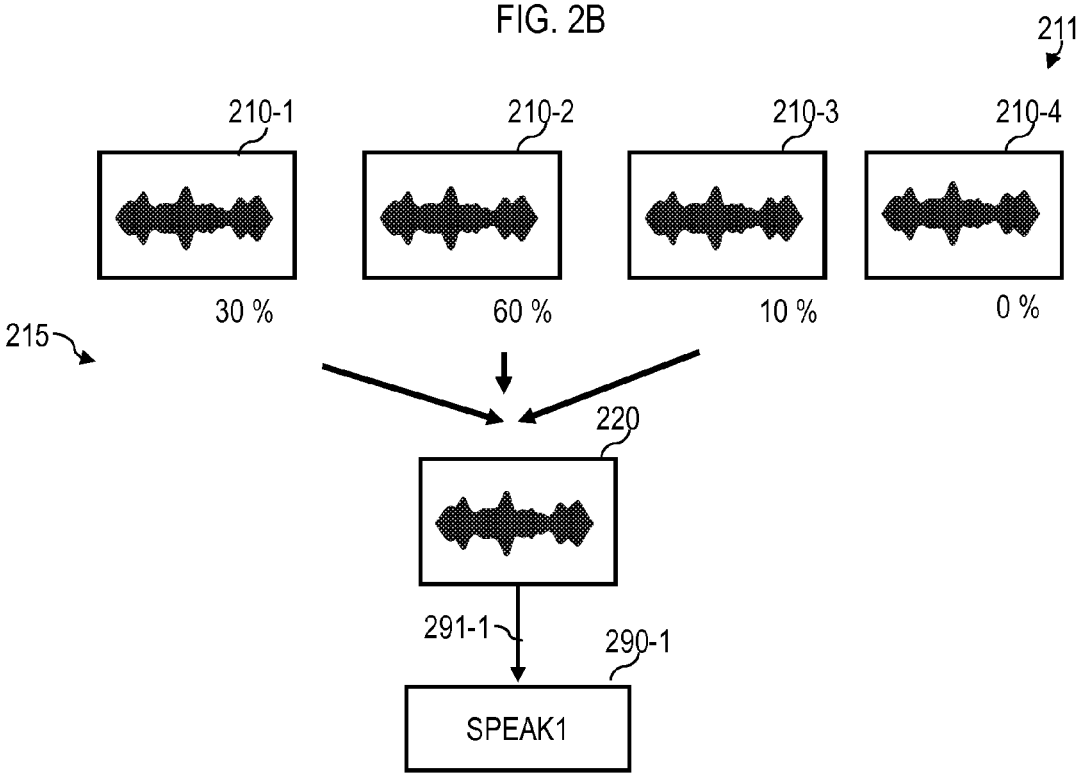
FIG. 2C schematically illustrates the mixing of a plurality of channels of the multi-channel audio data to a given output channel of the audio system when emulating a plurality of virtual positions according to various embodiments.

Referring further to FIG. 2C: generally, it is possible to mix a plurality of channels of the multi-channel audio data 211 to a given output channel to achieve the desired audible perception of audio originating from the virtual positions. Generally, the control data 215 can specify amplitude, phase, delay, and/or frequency filter parameters, etc. to achieve this effect.

Figure 3:
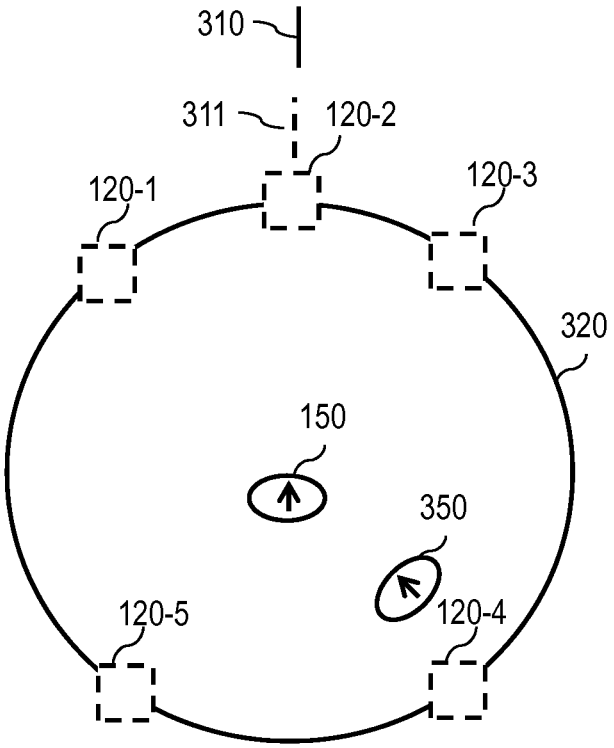
FIG. 3 illustrates preset positions of speakers, a first listening position, and a second listening position according to various embodiments.

In FIG. 3, the preset positions 120-1-120-5 are shown which result in the virtual stage being in conformity with the content of the multi-channel audio data at a first listening position 150. A scenario is shown where a second listening position 350 deviates from the first listening position 150. As can be seen from FIG. 3, the second listening position 350 has a different location and a different orientation than the first listening position 150; it is possible that both the first and second listening positions 150, 350 are located within the audio sweet spot (not shown in FIG. 3). Such a scenario may result if, e.g., the user has moved to a writing table or working desk at the second listening position 350. It is then desirable to adjust or set the virtual positions 110-1-110-5 such that at the second listening position 350 the virtual stage is correctly perceived.

The virtual positions 110-1-110-5 may be set by a user input received via a HMI of the audio system and/or automatically set, e.g., according to a calibration routine. The virtual positions 110-1-110-5 may be set, according to the user input 410, such that the first listening position 150 is transitioned to the second listening position 350 (cf. FIG. 4), thus resulting in a turning and shifting of the virtual stage. Here, the user input 410 has two components: first, a change of the location of the virtual positions 110-1-110-5; second, a change of the orientations of the virtual positions 110-1-110-5.

Figure 4:
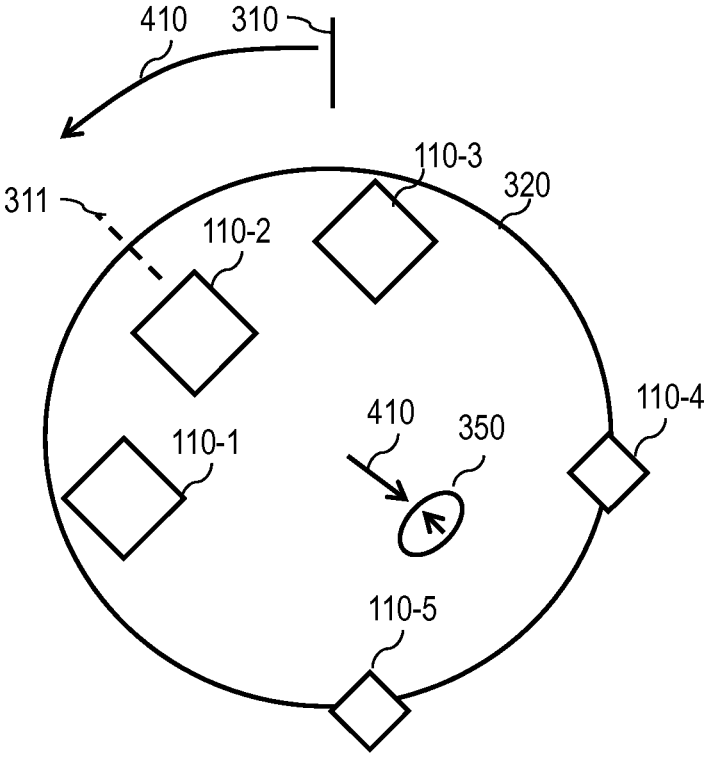
FIG. 4 illustrates the rotation of corresponding virtual positions to change to orientation of the listening position according to various embodiments.

To compensate for the increased distance between the second listening position 350 and the center preset position 120-2 corresponding to the center speaker, the amplitude of playback for the left/right/center virtual positions 110-1-110-3 is increased (illustrated in FIG. 4 by the larger squares). In the scenario of FIGS. 3 and 4, the virtual positions 110-1-110-4 are defined with respect to a reference radial distance 320. Generally, it is possible that the virtual positions 110-1-110-5 are offset against the reference radial distance 320. For example, the user input 410 can indicate a corresponding radial offset. Thereby, it becomes possible to flexibly move back and forth the respective virtual positions 110-1-110-5 with respect to a listening position 150, 350. To adjust the radial offset, it is possible that amplitudes, phase and/or delay are adjusted.

From a comparison of FIGS. 3 and 4, it can be seen that this scenario further corresponds to a turning of the virtual stage. For example, a respective user input 410 specifying a respective rotation of the reference direction 311 of the virtual positions 110-1-110-5 with respect to the reference direction 310 of the preset positions 120-1-120-5 may be relied upon. In such a scenario, a user can conveniently rotate the virtual stage at arbitrary angles. Thereby, different listening positions 150, 350 can be taken into account; e.g., with respect to the display 160 (cf. FIG. 1). A virtual turn of the listening direction or listening environment becomes possible.

The user input 410 can take various forms. For example, the user input 410 can be defined with respect to the position of the display 160, the listening position 150, 350, a head orientation of the user, or a reference coordinate system. By such techniques, the user may easily specify the desired virtual positions 110-1-110-5.

In FIGS. 3 and 4, a uniform rotation of the virtual positions 110-1-110-5 with respect to the reference direction 310 is shown; thus, the virtual stage is uniformly rotated. Generally, it is also possible that the virtual position 110-1-110-5 of only a single channel 210-1-210-4 of the multi-channel audio data 211 is rotated.

Generally, the user input 410 may operate according to presets. For example, the user may predefine certain listening positions 150, 350. Then, by selecting a specific listening position 150, 350, respectively by selecting specific candidate virtual positions from the list of presets, a simple and fast control becomes possible.

Figure 5:
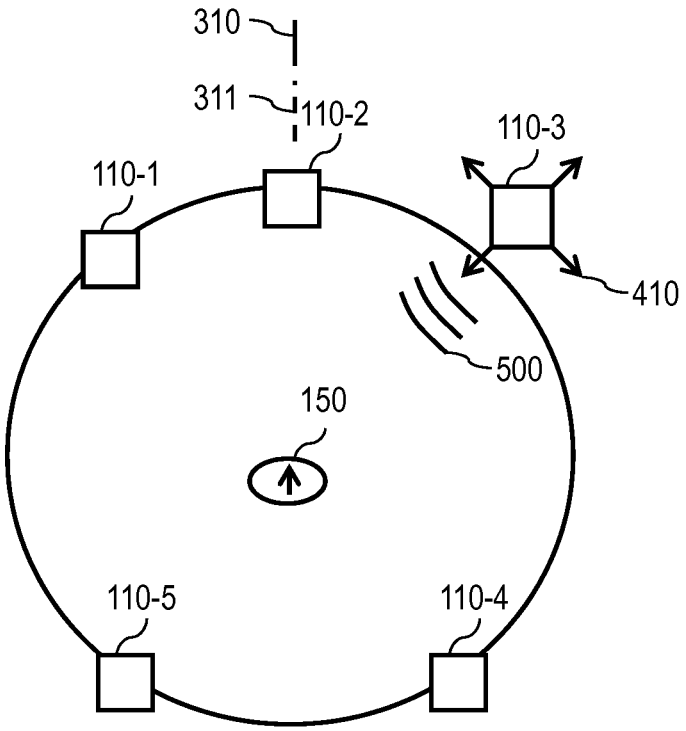
FIG. 5 illustrates the moving of the virtual position according to various embodiments.

In FIG. 5, a positioning routine allowing to freely move the virtual position 110-3 according to the user input 410 is shown. The respective channel 210-1-210-4 of the multi-channel audio data 211 is routed to the output channels according to control data which corresponds to a present virtual position 110-3. The corresponding playback 500 is perceived by the user. Other channels of the multi-channel audio data 211 may be muted. Thereby, the present virtual position 110-3 may be audibly perceived by the user. The user can freely move around the present virtual position 110-3 and the control data is correspondingly updated. The corresponding user input 410 can be an offset value of the present virtual position 110-3. The corresponding user input 410 may be in polar coordinates or Cartesian coordinates; the user may select the respective coordinate system.

Figure 6:
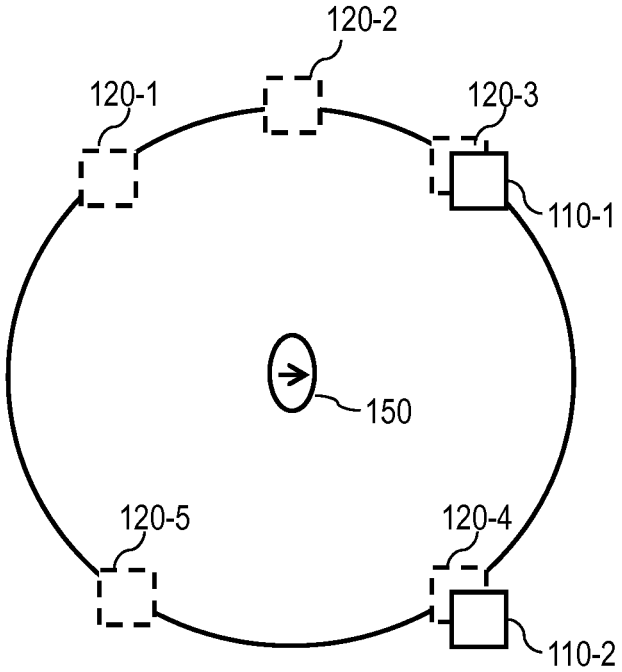
FIG. 6 illustrates the uniform rotation of the virtual positions of two speakers according to various embodiments.

In FIG. 6, a scenario is shown where the virtual positions 110-1, 110-2 of stereo two-channel audio data 211 are assigned to the preset positions 120-3, 120-4. Here, the corresponding speakers (not shown in FIG. 6) are assigned to the corresponding channels 210-1-210-4 of the multi-channel audio data 211. In the scenario of FIG. 6, a 5.1 audio system is used to play back the stereo two-channel audio data. The front right speaker and right surround speaker are mapped to the front left and front right channel, respectively. Thus an orientation of the virtual stage can be turned by 90° if compared to the conventional case. Employing the techniques as mentioned above, the turning is not restricted to a 90° turn. This scenario enables to preserve a correct orientation of the virtual stage even if the listener turns, e.g., by 90°. Generally, via the user input 410, the user may add a custom channel mapping which fits the specific demands of the specific listening environment.

Thus, in the scenario of FIG. 6, the physical speaker fulfills a different role than intended by the standard arrangement for which the multi-channel audio data is provided.

This generally applies to scenarios where the virtual position does not deviate from the preset position. For example, the front-right speaker-according to the standard arrangement—may be assigned as the rear-left speaker.

For example, in the scenario of FIG. 6 it is possible to further enhance the audio experience if the audio system comprises a larger number of output channels. For example, if a 7.1 audio system is employed, it could be possible to implement a center speaker located in-between the virtual positions 110-1, 110-2. Thus, 5.1 multi-channel audio data may be played back.

Figure 7:
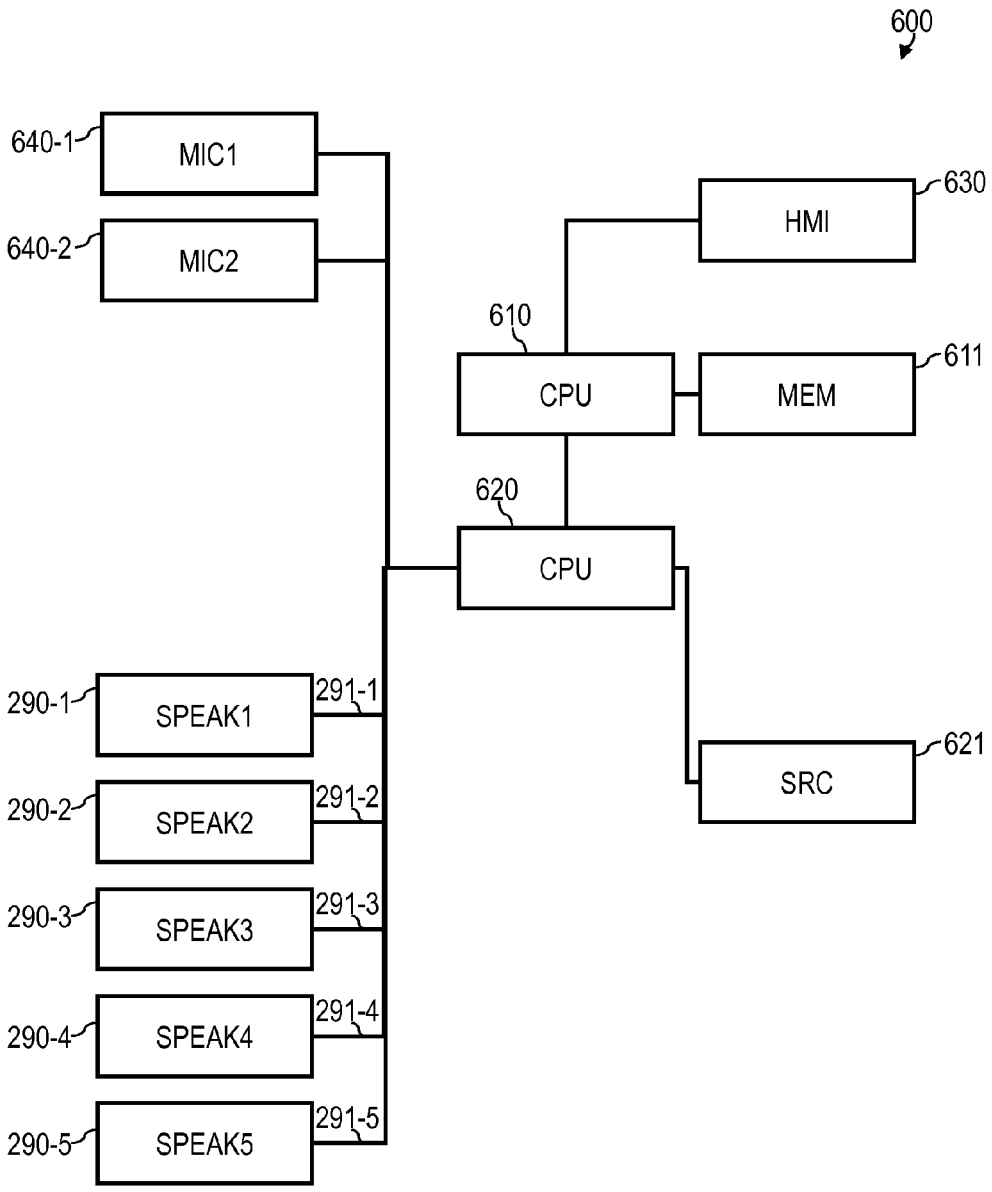
FIG. 7 is a schematic illustration of an audio system according to various embodiments.

In FIG. 7, a schematic illustration of a sound system 600 according to various embodiments is shown. The sound system 600 comprises a first processor 610 and a second processor 620. The processors 610, 620 may be implemented as a multi-core processor and/or rely on distributed computing. The first processor 610 establishes communication with an HMI 630 and a memory 611. The first processor 610 is configured to determine the control data. The second processor 620 is configured to handle the multi-channel audio data. The second processor 620 is configured to execute the routing. It should be understood that generally the functionality of the first and second processor 610, 620 may also be implemented in a single processor or shared between a larger number of processors (not shown in FIG. 7).

The sound system 600 further comprises the memory 611. The memory 611 stores control data for the first processor 610. Executing the control data causes the first processor 610 to execute techniques according to various embodiment explained above. In particular, executing the control data causes the processor 610 to execute techniques associated with the establishing of the control instructions 215 based on the present positions 120-1-120-5 and virtual positions 110-1-110-5. The first processor 610 provides the control data to the second processor 620 to route the channels 610-1-610-4 of the multi-channel audio data 211 to the output channels 291-1-291-5 based on the control instructions 215.

The second processor 620 in the scenario of FIG. 7 can be configured to flexibly forward different inputs associated with the audio tracks of the channels of the multi-channel audio data to the different output channels 291-1-291-5 as part of the routing based on the control instructions. For this, it is possible to implement a comparably simple switching matrix where input channels are associated with one or more output channels 291-1-291-5. It is also possible that the second processor 620 is configured to individually and/or coherently process the audio tracks of the channels of the multi-channel audio data (audio processing). For example, the second processor 620 may include a digital signal processor (DSP); e.g., the audio processing may be implemented in hardware and/or in software.

Further shown in FIG. 7 is the HMI 630 and the audio source 621. The audio source 621 provides the multi-channel audio data 211 including the plurality of channels 210-1-210-4. Content of the multi-channel audio data is positioned with respect to the virtual stage.

In the scenario of FIG. 7, the audio system 600 comprises five output channels 291-1-291-5. Five speakers 290-1-290-5 are connected to the output channels 291-1-291-5. Optionally, the audio system 600 may comprise an end stage. The end stage may comprise an amplifier. The amplifier may be configured to amplify audio signals for each one of the output channels 291-1-291-5.

The sound system 600 further comprises two microphone interfaces which are connected to microphone 640-1, 640-2. The processors 610, 620 are configured to execute a calibration routine. The calibration routine comprises routing reference signals via the output channels 291-1-291-5. Via each one of the microphone interfaces the second processor 620 receives a recording of the playback of the reference signal as a respective calibration track. Based on the calibration tracks, the first processor 610 is configured to determine the preset positions 120-1-120-5 of the plurality of speakers 290-1-290-4. Employing such a calibration routine, it becomes possible to determine the preset positions 120-1-120-5 as the actual positions of the plurality of speakers 290-1-290-4 in an accurate manner. Further, the first processor 610 is configured to determine the virtual positions 110-1-110-5 based on the calibration tracks; e.g., the first processor 610 can be configured determine the virtual positions 110-1-110-5 such that the virtual stage aligns with respect to a reference direction which may be defined by a setup of the microphones 640-1, 640-2 and/or a corresponding user input. Asymmetries between left and right orientations can be compensated for. A center image may be aligned with the reference direction.

Figure 8:
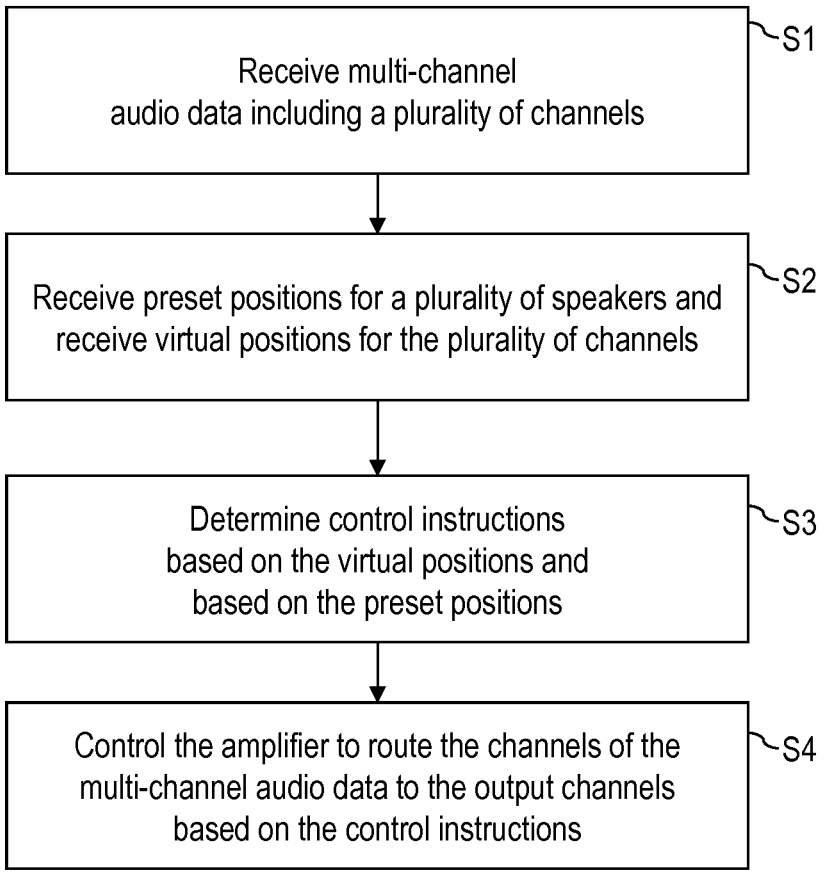
FIG. 8 is a schematic illustration of a method according to various embodiments.

In FIG. 8, a flowchart of the method according to the various embodiments is shown. At S1, the multi-channel audio data 211 including the plurality of channels 210-1-210-4 is received from the audio source 612.

At S2, the preset positions 120-1-120-5 of the plurality of speakers 290-1-290-5 are received. For example, the preset positions can be stored in the memory 611. Further, at S2, the virtual positions 110-1-110-5 for the plurality of channels 210-1-210-4 are received. For example, the virtual positions can be stored in the memory 611.

Next, at S3, the control instructions 215 are determined based on the virtual positions 110-1-110-5 and based on the preset positions 120-1-120-5.

Next, at S4, the channels 210-1-210-4 of the multi-channel audio data 211 are routed to the output channels 291-1-291-5 based on the control instructions 215.

Although the disclosure has been shown and described with respect to certain preferred embodiments, equivalents and modifications will occur to others skilled in the art upon the reading and understanding of the specification. The present disclosure includes all such equivalents and modifications and is limited only by the scope of the appended claims.

For example, above the techniques of routing have been primarily discussed in terms of forwarding an audio track associated with a given channel of the multi-channel audio data. It is possible that the routing includes techniques of audio processing. Here, it is possible that to some larger or smaller degree the audio tracks associated with the different channels of the multi-channel audio data are re-computed or modified according to the audio processing.

The invention claimed is:

1. An audio system, comprising:

at least one processor configured to receive multi-channel audio data including a plurality of channels from an audio source, the at least one processor comprising a plurality of output channels, each output channel being configured to connect to a respective speaker, wherein the at least one processor is coupled to a memory and is further configured to receive, from the memory, position information indicating preset positions of the plurality of speakers and virtual positions associated with the plurality of channels of the multi-channel audio data, wherein the at least one processor is further configured to establish control instructions based on the preset positions and the virtual positions, wherein the at least one processor is further configured to route the channels of the multi-channel audio data to the output channels based on the control instructions, wherein the audio system further comprises a human machine interface configured to receive a user input from a user of the audio system, wherein the at least one processor is configured to determine and write to the memory at least one of the preset positions and/or at least one of the virtual positions based on the user input, and wherein the at least one processor is further configured to execute a positioning routine, the positioning routine comprising:

routing, with the at least one processor, a given channel of the multi-channel audio data to two or more output channels based on the control instructions established for a present virtual position, receiving, with the human machine interface, the user input indicating an offset value for the present virtual position, and adjusting, with the at least one processor, the routing of the given channel of the multi-channel audio data based on the offset value.

2. The audio system of claim 1, wherein the at least one processor is further configured to route at least one channel of the multi-channel audio data to two or more output channels based on the control instructions.

3. The audio system of claim 1, wherein the user input indicates, for each one of the plurality of speakers, a rotation of a corresponding one of the virtual positions with respect to a reference direction.

4. The audio system of claim 3, wherein the user input indicates a uniform rotation of the virtual positions with respect to the reference direction.

5. The audio system of claim 1, wherein the user input indicates a selection of a given one of a plurality of candidate virtual positions as the at least one virtual position determined by the at least one processor based on the user input.

6. The audio system of claim 1, wherein the user input indicates a radial offset between the at least one virtual position determined by the at least one processor based on the user input and a reference radial distance.

7. The audio system of claim 1, wherein the user input indicates an assignment of the at least one virtual position determined by the at least one processor based on the user input to the at least one preset position determined by the at least one processor based on the user input.

8. The audio system of claim 1, wherein the user input indicates the at least one virtual position and/or the at least one preset position determined by the at least one processor based on the user input with respect to at least one of a position of a display, a listening position of the user, a head orientation of the user, and a reference coordinate system.

9. The audio system of claim 1, wherein the at least one processor is configured to determine the control instructions for each one of the virtual positions based on a spatial difference between the respective virtual position and at least one respective neighboring one of the preset positions.

10. The audio system of claim 1, wherein the at least one processor is further configured to mix at least two channels of the multi-channel audio data to a given output channel based on the control instructions.

11. An audio system comprising:

at least one processor configured to receive multi-channel audio data including a plurality of channels from an audio source, the at least one processor comprising a plurality of output channels, each output channel being configured to connect to a respective speaker, wherein the at least one processor is coupled to a memory and is further configured to receive, from the memory, preset positions of the plurality of speakers and virtual positions associated with the plurality of channels of the multi-channel audio data, wherein the at least one processor is further configured to establish control instructions based on the preset positions and the virtual positions, wherein the at least one processor is further configured to route the channels of the multi-channel audio data to the output channels based on the control instructions, wherein the audio system further comprises at least two microphone interfaces, wherein the at least one processor is configured to execute a calibration routine, the calibration routine comprising the at least one processor routing a reference signal via the output channels and the at least one processor controlling the at least two microphone interfaces to each receive a recording of a playback of the reference signal as a respective calibration track, and wherein the at least one processor is configured to determine at least one of the preset positions of the plurality of speakers and the virtual positions based on the detected calibration signals.

12. A method, comprising:

receiving, with at least one processor of an audio system, multi-channel audio data including a plurality of channels from an audio source;

receiving, with the at least one processor, position information indicating preset positions of a plurality of speakers connectable to the audio system via respective output channels and virtual positions associated with the plurality of channels of the multi-channel audio data;

establishing, with the at least one processor, control instructions based on the preset positions and the virtual positions; and routing, with the at least one processor, the channels of the multi-channel audio data to the output channels based on the control instructions, wherein the audio system further comprises at least two microphone interfaces, wherein the method further comprises executing, with the at least one processor, a calibration routine, the calibration routine comprising:

routing, with the at least one processor, a reference signal via the output channels, and controlling, with the at least one processor, the at least two microphone interfaces to each receive a recording of a playback of the reference signal as a respective calibration track, and wherein the method further comprises determining, with the at least one processor, at least one of the preset positions of the plurality of speakers and the virtual positions based on detected calibration signals.

13. The method of claim 12, further comprising routing at least one channel of the multi-channel audio data to two or more output channels based on the control instructions.

14. The method of claim 12, further comprising determining and storing in a memory of the audio system at least one of the preset positions and/or at least one of the virtual positions based on user input received via a human machine interface of the audio system.

15. The method of claim 14, wherein the user input indicates, for each one of the plurality of speakers, a rotation of a corresponding one of the virtual positions with respect to a reference direction.

16. The method of claim 15, wherein the user input indicates a uniform rotation of the virtual positions with respect to the reference direction.

17. The method of claim 14, wherein the user input indicates a radial offset between the at least one virtual position determined by the at least one processor based on the user input and a reference radial distance.

18. The method of claim 14, further comprising determining, with the at least one processor, the control instructions for each one of the virtual positions based on a spatial difference between the respective virtual position and at least one respective neighboring one of the preset positions, and determining, with the at least one processor, the control instructions for each one of the virtual positions based on a difference vector between the respective virtual position and a listening position.

* * * * *